United States Patent [19]

Kumano

[11] 4,299,155

[45] Nov. 10, 1981

[54] SUPPORTING CONSTRUCTION FOR KEYBOARD ASSEMBLY

[75] Inventor: Shinzi Kumano, Hamamatsu, Japan

[73] Assignee: Nippon Gakki Seizo Kabushiki Kaisha, Japan

[21] Appl. No.: 45,336

[22] Filed: Jun. 4, 1979

[30] Foreign Application Priority Data

Jun. 6, 1978 [JP] Japan ..... 53-076175[U]

[51] Int. Cl.[3] ..... G10C 3/02

[52] U.S. Cl. ..... 84/177; 84/186 R; 84/430; 84/433

[58] Field of Search ..... 84/1.01, 430, 433, 434, 84/435, 436, 177, 179, 186

[56] References Cited

U.S. PATENT DOCUMENTS

| | | | |
|---|---|---|---|
| 2,785,238 | 3/1957 | Bissonette et al. | 84/1.01 |
| 3,002,413 | 10/1961 | Scherer | 84/433 |
| 3,447,414 | 6/1969 | Duca | 84/436 |
| 3,499,971 | 3/1970 | Ohno | 84/436 |
| 3,543,631 | 12/1970 | Ohno | 84/434 |
| 3,570,359 | 3/1971 | Ohno | 84/433 |
| 3,693,492 | 9/1972 | Ohno | 84/436 |
| 3,750,522 | 8/1973 | Groves et al. | 84/433 |
| 3,835,235 | 9/1974 | Amano | 84/433 |
| 4,128,035 | 12/1978 | Erickson et al. | 84/434 |
| 4,129,057 | 12/1978 | Hoshi | 84/434 |

OTHER PUBLICATIONS

*Radio Electronics,* "Portable Mini Organ", by John S. Simonton, Jr., Jan. 1977, pp. 31–34.

*Primary Examiner*—L. T. Hix
*Assistant Examiner*—Alan Mathews
*Attorney, Agent, or Firm*—Ostrolenk, Faber, Gerb & Soffen

[57] ABSTRACT

A pair of key blocks bearing a keyboard assembly via an intervening frame are pivotally coupled to side boards of a musical instrument by means of pin-groove engagement, and a top board and a front cover of the instrument are both turnable upwards in order to allow free pivotal movement of the keyboard assembly. Pivotal mounting of the keyboard assembly allows easy access to its bottom construction for replacement, repairment and adjustment purposes.

8 Claims, 11 Drawing Figures

SUPPORTING CONSTRUCTION FOR KEYBOARD ASSEMBLY

BACKGROUND OF THE INVENTION

The present invention relates to an improved supporting construction for a keyboard assembly, and more particularly relates to improvement in the construction for detachablly supporting a keyboard assembly in position on an electronic musical instrument.

In general, the keyboard assembly for electronic musical instruments is required to have a construction which allows easy access to its bottom side construction for replacement, adjustment and repairment purposes.

In the conventional construction for supporting a keyboard assembly on an electronic musical instrument, each key block is coupled to an L-shaped support plate which is pivotally mounted to the associated side board via screws. This construction requires increased number of mechanical parts and complicated operation in mounting, thereby causing an unfavourable rise in manufacturing cost.

SUMMARY OF THE INVENTION

It is the basic object of the present invention to provide a supporting construction for a keyboard assembly which allows easy access to the bottom construction of the keyboard assembly.

It is another object of the present invention to provide a supporting construction for a keyboard assembly with reduced number of mechanical elements.

It is the other object of the present invention to provide a supporting construction for a keyboard assembly which can be very simply mounted to musical instruments.

In accordance with the basic concept of the present invention, a keyboard assembly is carried by a frame fixed sideways to a pair of key blocks and each key block is coupled to an associated side board of a musical instrument by means of pin-groove engagements so that the keyboard assembly is turnable upwards about its rear end pin-groove pivot. In order to enable this turning, a top board holding a control panel is turnable upwards about its rear end hinge and the front cover is turnable with respect to the top board about its rear end hinge.

DESCRIPTION OF PREFERRED EMBODIMENT

Figure 1:
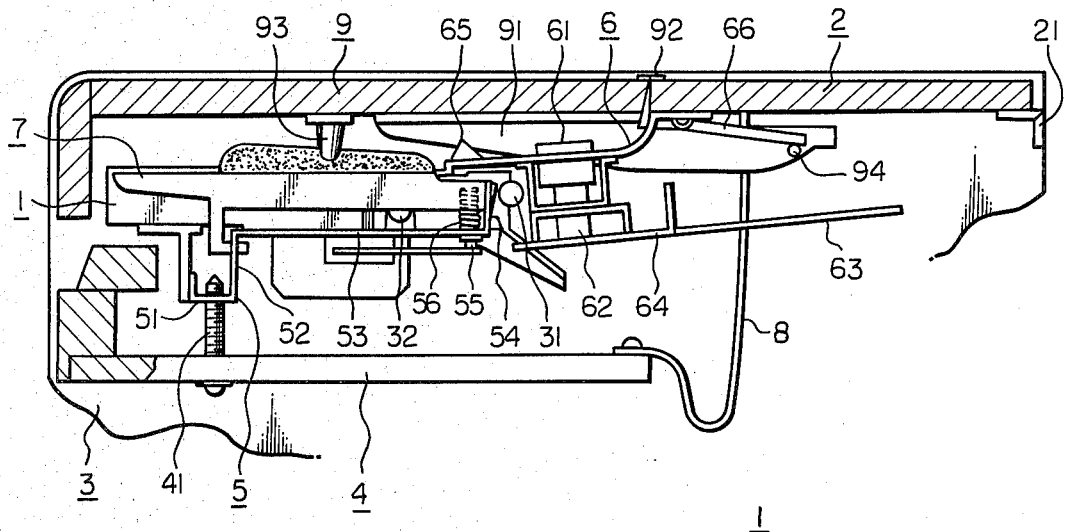
FIG. 1 is a side view, partly in section, of an embodiment of the supporting construction of the present invention and its related parts with the front cover and the top board being in the closed state.

A basic embodiment of the supporting construction in accordance with the present invention is shown in FIG. 1.

The supporting construction includes, as major elements, a pair of key blocks 1 arranged close to associated side boards 3 of the musical instrument and a frame 5 extending between the pair of key blocks 1. Keys 7 are placed on and supported by the frame 5 as hereinafter described in more detail.

Figure 2A:
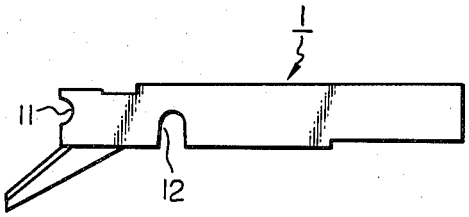
FIGS. 2A and 2B are side and perspective views of an embodiment of the left side key block used for the construction shown in FIG. 1, FIGS. 3A and 3B are side and perspective views of an embodiment of the right side key block used for the construction shown in FIG. 1.
Figure 2B:
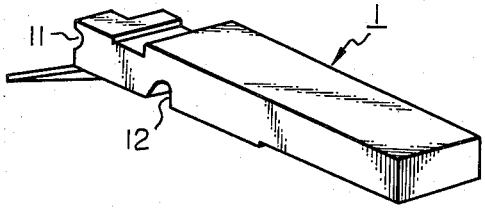
Figure 3A:
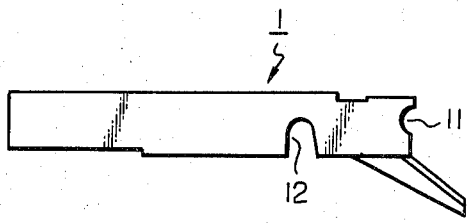
Figure 3B:
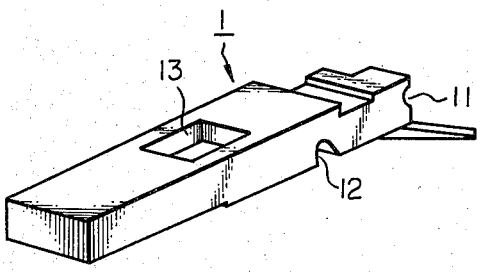

The key block 1 shown in FIGS. 2A and 2B is arranged to the left side of the keyboard whereas the key block 1 shown in FIGS. 3A and 3B is arranged to the right side of the keyboard.

As shown in FIGS. 2A and 2B, each key block 1 takes the form of an elongated substantially rectangular solid and is provided with a first transverse groove 11 formed in the rear surface thereof. The key block 1 is further provided with a second transverse groove 12 formed in the bottom surface thereof. In the case of the right side key block 1 shown in FIGS. 3A and 3B, a hollow 13 is formed in the top surface of the key block 1 in order to accomodate switches therein.

Figure 5:
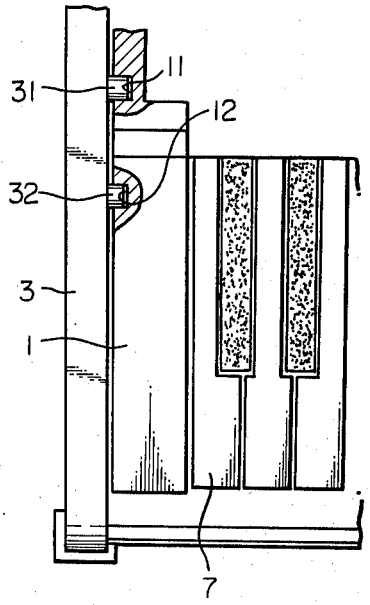
FIG. 5 is a fragmentary top view, partly in section, of the supporting construction shown in FIG. 1, FIGS. 6A and 6B are perspective views of the other embodiments of the left and right side key blocks used for the construction shown in FIG. 1.

At positions corresponding to the grooves 11 and 12 of each key block 1, the associated side board 3 is provided with first and second pins 31 and 32 projecting horizontally towards the keyboard as shown in FIG. 5. For the reason hereinafter described, the pins 31 and 32 are both circular in transverse cross sectional profile. Accordingly, the bottom portions of the grooves 11 and 12 are substantially semi-circular in transverse cross sectional profile.

In the assembled state of the keyboard, the first and second pins 31 and 32 on each side board 3 are received in the first and second grooves 11 and 12 formed in the associated key block, respectively. Thus, the vertical displacement of each key block 1 is limited by engagement of the first pin 31 with the first groove 11 whereas the horizontal and longitudinal displacement of the key block 1 is limited by engagement of the second pin 32 with the second groove 12.

Figure 4:
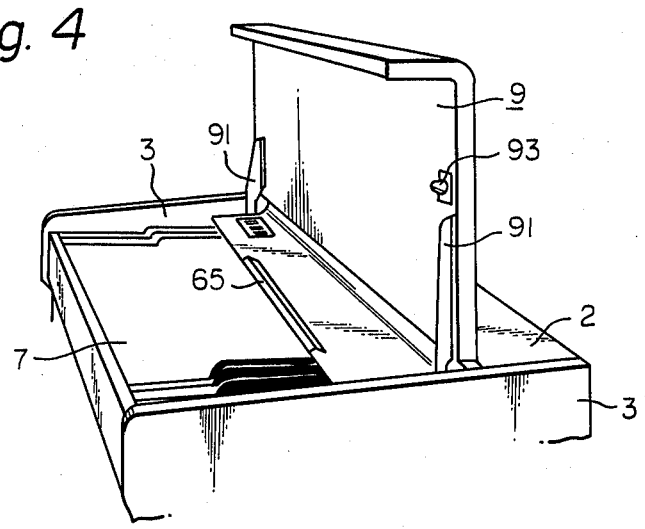
FIG. 4 is a perspective view of an electric piano embodying the present invention with the front cover being open.

The front and upper sides of the keyboard are spacedly covered by a front cover 9 which is coupled at the rear end to a top board 2 of the musical instrument via hinges 92. The front cover 9 is provided at each side end with a stay 91 which extends rearwards below the top board 2 when the front cover 9 is closed. The front cover 9 is further provided near its right side end with a downward projection 93. The projection 93 is seen in FIG. 4 also and used for automatic turning-off of an operation switch (not shown) arranged atop the right side key block 1 when the front cover 9 is closed. Thus, the operation switch can be surely turned off even when the player has failed to do so. The top board 2 is coupled at the rear end to the side boards 3 via hinges 21.

Due to the above-described dual hinge construction, the front cover 9 with the top board 2 is swingable upwards about the rearmost hinges 21 whereas the front cover 9 alone is swingable upwards about the top board 2 via the intermediate hinges 92 as shown in FIG. 4.

The stay 91 of the front cover 9 is provided near the rear end with a lateral pin 94.

Figure 7:
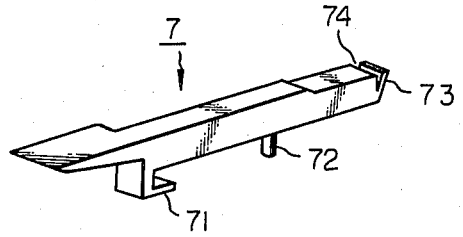
FIG. 7 is a perspective view of a key used in the construction shown in FIG. 1.

The construction of each key 7 is shown in detail in FIG. 7. The key 7 takes the form of an elongated substantially rectangular solid and provided, near the front end, with a bottom hook 71 and, about the middle of its length, with a bottom support 72. At the rear end of the key 7, a thin slant flap 73 extends upwards and rearwards in order to provide a V-shaped notch 74 opening upwards. Although not shown in the drawings, a depression or hollow is formed in the bottom surface of the key 7 near the rear end in order to provide a seat for a later described spring.

The frame 5 is provided with a front section 51 to be coupled to the key blocks 1, an intermediate vertical section 52 having a window (not shown), a horizontal section 53, and a rear vertical section 54, having a window (not shown).

In the assembled disposition of the keyboard shown in FIG. 1, the bottom hook 71 of each key 7 is inserted into the window in the intermediate vertical section 52 of the frame 5, the slant flap 73 is in engagement with the window in the rear vertical section 54, and the bottom support 72 rests on the horizontal section 53. The front section 51 is fixed to a bottom plate 4 via set bolts 41. A spring holder 55 is disposed near the rear end of the horizontal section 53 and a tension spring 56 is interposed between the spring holder 55 and the abovedescribed spring seat formed in the key 7. Due to the tension compression of this compression spring 56, each key 7 always has the urge to move its front end upward though the extent of the upward movement is somewhat limited by engagement of the bottom hook 71 of the key 7 with the intermediate vertical section 52 of the frame 5. Thus, the key 7 resumes its unoperated disposition when pressure on the key 7 is removed.

A control panel 6 extends between the side boards 3 and is fixed at the rear end to the bottom surface near the front end of the top board 2. A plurality of control switches 61 associated by an electric assembly 62 are disposed to the control panel 6. The control panel 6 further carries a printed circuit board 63 via channels 64. A music rack 65 is arranged on the control panel 6 near its front end.

A torsion spring 66 is pivoted to the rear end bottom of the control panel 6 with its rear end in contact with the lateral pin 94 on the stay 91 of the front cover 9.

A belt 8 is fixed at its one end to the rear end of the bottom plate 4 and its the other end to the bottom surface of the top board 2. The belt 8 is long enough to slack when the top board 2 is closed as shown in FIG. 1.

In order to incorporate the keyboard into the musical instrument, the keys 7 are assembled to the frame 5, and the frame 5 is in turn coupled to the key blocks 1.

Then the front cover 9 is turned upwards about its rear hinges 92. When the front cover 9 is turned to a certain extent, the rear end of the stay 91 of the front cover 9 abuts on the first pins 31 on the side boards 3 (see FIG. 4). That is, in the case of this embodiment, the first pins 31 act as a kind of stopper for the front cover 9. Next the keyboard with the key blocks 1 and the frame 5 is inserted from the front side until the first transverse grooves 11 in the key blocks 1 fully engage with the first pins 31 on the side boards 3. Thereafter, the keyboard is turned downwards about the first pins 31 until the second transverse grooves 12 in the key blocks 1 fully engage with the second pins 32 on the side boards 3. Finally, the frame 5 is fixed to the bottom board 4 via set bolts 41.

Figure 8:
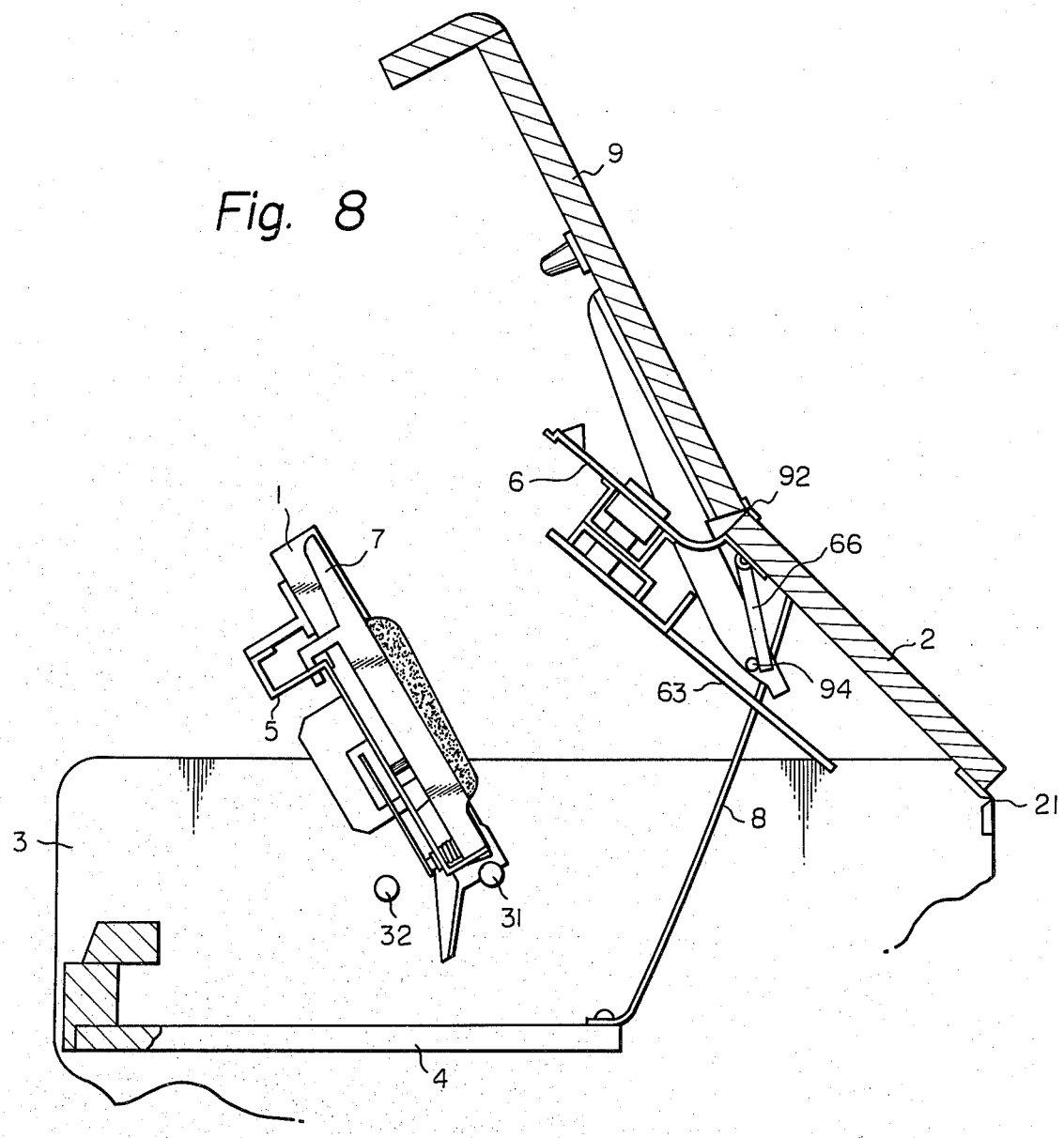
FIG. 8 is a side view, partly in section, of the supporting construction shown in FIG. 1 with the front cover, top board and the keyboard assembly being in an open state.

In order to have an access to the bottom construction of the keyboard, it is necessary to turn the keyboard upwards about the first pins 31 on the side boards 3. Consequently, the control panel 6 must be placed out of the moving ambit of the keyboard when the latter is to be turned upwards. In order to effect this, the top board 2 is turned upwards about the rearmost hinges 21 until the belt 8 is stretched. Next, the front cover 9 may be turned upwards about the intermediate hinges 92. Then the keyboard assembly can be freely turned upwards about the first pin 31 after the set bolts 41 are removed. A disposition of the related parts during the abovedescribed process is illustrated in FIG. 8.

The torsion spring 66 always urges the rear end of the stay 91 to move downwards. Due to this repulsion, abrupt closing of the front cover 9 can be well prevented when same is to be closed.

In the case of the key blocks 1 shown in FIGS. 2A to 3B, the transverse grooves 11 and 12 both extend over the entire width of each key block 1. However, each transverse groove 11 or 12 may terminate at a proper position between both lateral sides of the associated key block 1 as long as the groove opens in the side of the key block 1 closer to the associated pin 31 or 32 and is long enough to stably receive the associated pin 31 or 32.

Figure 6A:
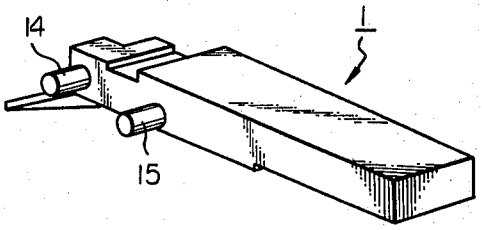
Figure 6B:
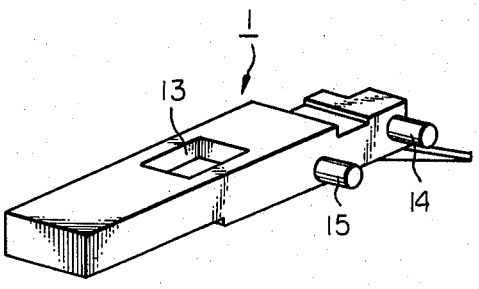

In the case of the foregoing embodiments, the transverse grooves 11 and 12 are formed in each key block 1 and the pins 31 and 32 are formed on the associated side board 3 of the musical instrument. As an alternative, the key blocks 1 shown in FIGS. 6A and 6B are each provided with first and second pins 14 and 15 projecting laterally from one side surface thereof. In this case, corresponding grooves (not shown) receptive of these pins are formed in the surface of each side board 3 facing the associated key block 1.

In accordance with the present invention, the pin-groove engagements successfully ban undesirable displacement of the keyboard assembly and its related parts on the musical instrument. In addition the pivotal nature of the keyboard supporting construction allows easy access to the bottom construction of the keyboard and its related parts for replacement and/or repair purposes. This is particularly important in the case of electric musical instruments in which keyboards are accompanied with intricate electronic and electric systems generally in need of frequent function check, maintenance and adjustment.

I claim:

1. Improved supporting construction for a keyboard assembly on an electronic musical instrument comprising an electronic musical instrument including a keyboard assembly, a frame for bearing said keyboard assembly and said frame being elongated in the width direction of said keyboard assembly, said frame having lateral ends, said musical instrument having side boards beyond said lateral ends, a pair of key blocks, each being coupled to a respective said lateral end of said frame, each said key block being coupled to an associated said side board of said musical instrument by means of a pivotal engagement therebetween, said musical instrument having a top board thereover and above said keyboard assembly, said top board having a rear end and a front end, the latter extending toward said keyboard assembly, said instrument also having a front cover placeable over said keyboard assembly and located forward of said top board front end, said top board fixedly carrying a forwardly extending control panel, first hinges coupling said rear end of said top board of said musical instrument to said side boards in an upwardly turnable arrangement, and second hinges coupling said rear end of said front cover of said musical instrument to said front end of said top board in an upwardly turnable arrangement.

2. Improved supporting construction as claimed in claim 1 in which each said key block has a rear and a bottom surface and is provided with a first transverse groove formed in its said rear surface and a second transverse groove formed in its said bottom surface, and each said associated side board is provided with a first pin in engagement with said first groove and a second pin in engagement with said second groove, respectively.

3. Improved supporting construction as claimed in claim 1 in which each said key block is provided with first and second pins laterally projecting from its one side surface closer to said associated side board, and each said side board is provided with first and second horizontal grooves engageable with said first and second pins.

4. Improved supporting construction as claimed in any of claims 1, 2 or 3 in which:

said musical instrument includes a bottom board;

said frame includes, in one body, a front section adapted for coupling to said key blocks and for fixing to said bottom board of said musical instrument, an intermediate vertical section having first window means, a horizontal section and a rear vertical section having second window means, a plurality of keys arrayed between said key blocks, each said key is provided with a bottom hook engageable with said first window means of said frame, a bottom support adapted for resting on said horizontal section of said frame, a rear end slant flap engageable with said second window means, and a spring seat formed in the rear end bottom surface of said key, a plurality of spring holders are disposed near the rear end of said horizontal section of said frame, and a tension spring interposed between said spring seat of each key and each said spring holder.

5. Improved supporting construction as claimed in any of claims 1, 2 or 3 including a music rack carried on said top board, said control panel having thereon a plurality of control switches, an electric assembly connected with said control switches and a printed circuit board electrically connected to said electric assembly.

6. Improved supporting construction as claimed in claim 5 in which said instrument has a bottom board beneath said keyboard assembly, said top board is bound to the rear end of said bottom board of said musical instrument by means of a belt, and said belt is of a length to be slack when said top board is closed.

7. Improved supporting construction as claimed in claim 1 in which said front cover has on each side end a rear stay which extends below said top board when the latter is closed, said rear stay is provided near the rear end with a lateral pin, and a torsion spring pivoted at one end to the rear end bottom of said control panel bears at the other end on said lateral pin of said rear stay.

8. Improved supporting construction as claimed in claim 1 in which said front cover is provided near one side end with a bottom projection, an operation switch provided on the corresponding said side key block, said bottom projection being located to contact and turn off said operation switch when said front cover is closed completely.

* * * * *